US005374083A

United States Patent [19]

Slocomb

[11] Patent Number: 5,374,083

[45] Date of Patent: Dec. 20, 1994

[54] VARIABLE PERIOD DIARY

[76] Inventor: John L. Slocomb, P.O. Box 476, Sunnybank, Queensland 4109, Australia

[21] Appl. No.: 969,733

[22] Filed: Oct. 29, 1992

[30] Foreign Application Priority Data

Oct. 31, 1991 [AU] Australia ..... 86891/91

[51] Int. Cl.[5] ..... B42D 15/00

[52] U.S. Cl. ..... 283/2; 283/52.1

[58] Field of Search ..... 283/2, 52.1

[56] References Cited

U.S. PATENT DOCUMENTS

| | | | |
|---|---|---|---|
| 476,263 | 6/1892 | Guidinger | 283/2 |
| 2,731,746 | 1/1956 | Newman | 283/2 X |
| 3,605,307 | 9/1971 | Dickson | 283/2 X |
| 4,285,147 | 8/1981 | Kolar | 283/2 X |
| 4,793,634 | 12/1988 | Alloggiamento | 283/2 |
| 5,026,095 | 6/1991 | Hoyeck | 283/2 |

FOREIGN PATENT DOCUMENTS

| | | |
|---|---|---|
| 264549 | 4/1988 | European Pat. Off. . |
| 2301860 | 7/1974 | Germany . |
| 91/04161 | 5/1991 | WIPO . |
| 91/08909 | 8/1991 | WIPO . |

*Primary Examiner*—Paul A. Bell

*Attorney, Agent, or Firm*—Amster, Rothstein & Ebenstein

[57] ABSTRACT

A calendar assembly providing day and date information and including date data (11), day names (13) and association means (14) for selectively associating said date data (11) with said day names (13). The date data (11) includes day and month date data (13) for a full calendar and the day names (13) comprises a series of ordered full week day names, the calendar assembly being regularly arranged information zones (12) and either day names (13) or date data (11) in said information zones (12) providing a sequence of day names (13) or date data (11) and the other of the day name (13) or date data (11) being provided separately of the information zones (12) and the association means (14) being operable to selectively align the date data (11) and the day names (13). When provided in the form of plurality of pages, a diary assembly is disclosed and each information zone (12) may include a writing zone. The association means (14) is a replaceable element alignable with the relevant date data (11) and the replaceable element is adapted to be adhered to or mechanically locked in its selected operative position.

9 Claims, 6 Drawing Sheets

VARIABLE PERIOD DIARY

This invention relates to a variable period diary or calendar.

This invention has particular application to diaries having inter alia, days, dates and space for notes and for illustrative purposes reference will be made to such application. However, it will be understood that this invention could be used in other applications such as desk calendars, year planners, almanacs and such like and hereinafter collectively referred to as calendars.

Diaries and day planners have been widely and successfully used to date and mostly include date data such as day of the week, day of the month, month, year with other useful features and/or features of interest such as daily quotations, holidays, festivals and such like. Usually, such diaries are for a particular year or period within or beyond a calendar year, such as financial year diaries, two, three, four or five year diaries, half year diaries and such like. Similarly, calendars may be used to remind a user of upcoming events, to plan ahead, to avoid conflicts in the timing of planned activities and such like.

Where the day of the week is omitted from the date data, users must make a guess as to whether their plans for events, meetings and the like have been scheduled for a week day or a week-end. In all major economies of the world and in all fields of human endeavour therein, human activity is governed by a seven day week. Moreover, since the seasons change from summer to winter and back again on a yearly cycle conveniently divided into months of varying length (and varying coincidence between cultures), it is convenient to include the month in the date data in a calendar.

Since the number of days in a year does not evenly divide by the number of days in a week, the corresponding days of the week are precessed by one calendar date each ordinary year or two calendar dates each leap year. Thus, Jan. 1, 1991 was a Tuesday, and Jan. 1, 1992 was a Wednesday, but since 1992 was a leap year, Jan. 1, 1993 falls on a Friday.

The present invention aims to provide a variable period calendar which is not rendered obsolete once the year for which they have been published has commenced or is over and which will be reliable and efficient in use.

With the foregoing in view, this invention in one aspect resides broadly in a calendar assembly providing day and date information and including:

date data;

day names, and association means for selectively associating said date data with said day names. Preferably the date data includes day and month date data for a full calendar and the day names comprises a series of ordered full week day names. Preferably the calendar assembly includes regularly arranged information zones and either day names or date data in said information zones providing a sequence of day names or date data. The information zones may be arranged on a single page or a plurality of pages, either one or more to a page. It is also preferred that the other of said day name or date data is provided separately of said information zones and said association means is operable to selectively align said date data and said day names.

In a further preferred form, there is provided indication means for indicating the appropriate period or periods for the data. A plurality of dates may be accommodated on a sheet or sheets sufficient to constitute a calendar year, financial year, or other desired period, and a plurality of such sheets may be joined together to form a diary.

In another aspect, this invention resides broadly in diary assembly including:

a plurality of pages;

information zones on said pages;

either day names or date data arranged with said information zones, either one or more per page to provide a sequence of day names or date data, and the other of said day name or date data being provided separately of said pages whereby said other of said day name or date data may be operatively aligned with the day names or date data arranged with said information zones.

Each information zone may include a writing zone and preferably the other of said day name or date data is provided with means for maintaining the operative alignment. For example, it is preferred that the other of said day name or date data is provided on a replaceable element alignable with the relevant date data and the replaceable element is adapted to be adhered to or mechanically locked in its selected operative position.

In a further preferred form, the other of the day name or date data on the replaceable element is provided in a row or column and the day name or date data arranged with the information zones is provided at or near an edge of the information zone adjacent the replaceable element. The replaceable element is preferably separate from the pages.

The day names may be positioned in any way, such as having the date data fixed or permanently applied in or to the diary assembly and the day names aligned therewith so as to provide accurate dates including day name and date for selected periods. Preferably, however, the day names are provided on the replaceable element and the date data is arranged with the information zones.

The alignment of the replaceable element may be effected by adhesively attaching the replaceable element into the diary by gum, glue, stickifier or such like. Alternatively, the replaceable element is detachably attachable by temporary mechanical attachment means such as velcro, interference fit or mechanical locking into a sheath, slot, pocket or scabbard or the like. In a further alternative form, the replaceable element may be in the form of an overlay having the other of the day name or date data printed or the like on a clear or transparent material and arranged to fold over respective pages of the calendar or diary.

In order that this invention may be more readily understood and put into practical effect, reference will now be made to the accompanying drawings which illustrate a preferred embodiment of the invention, wherein.

Figure 1:
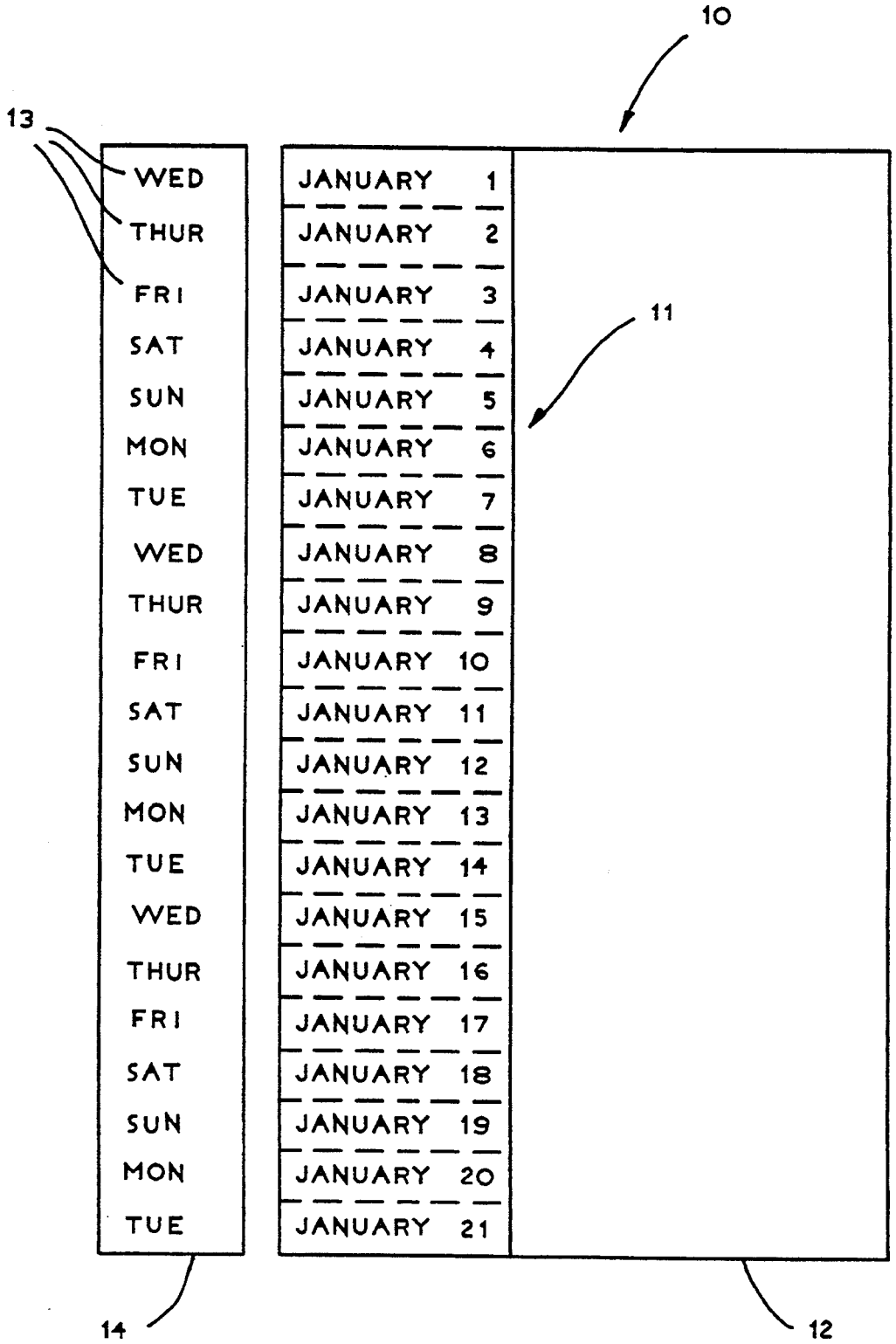
FIG. 1 illustrates an example of a portion of a variable period diary according to a preferred embodiment of the invention.

Referring to FIG. 1, a portion such as a page 10 of a variable period diary includes a notepad portion 12 with diary dates 11 printed permanently thereon. A separate day name portion 14 having a plurality of day names 13 may be aligned with the diary dates 11 as shown. In the example shown, the relevant day name 13 Wednesday for January 1 is appropriate for a range of years such as 1992, 1997, 2003, 2014, 2020, 2025, 2031 and so on. However, for the intervening years, a new copy of the separate day name portion 14 is provided with the day names realigned for the appropriate respective intervening year.

Figure 2:
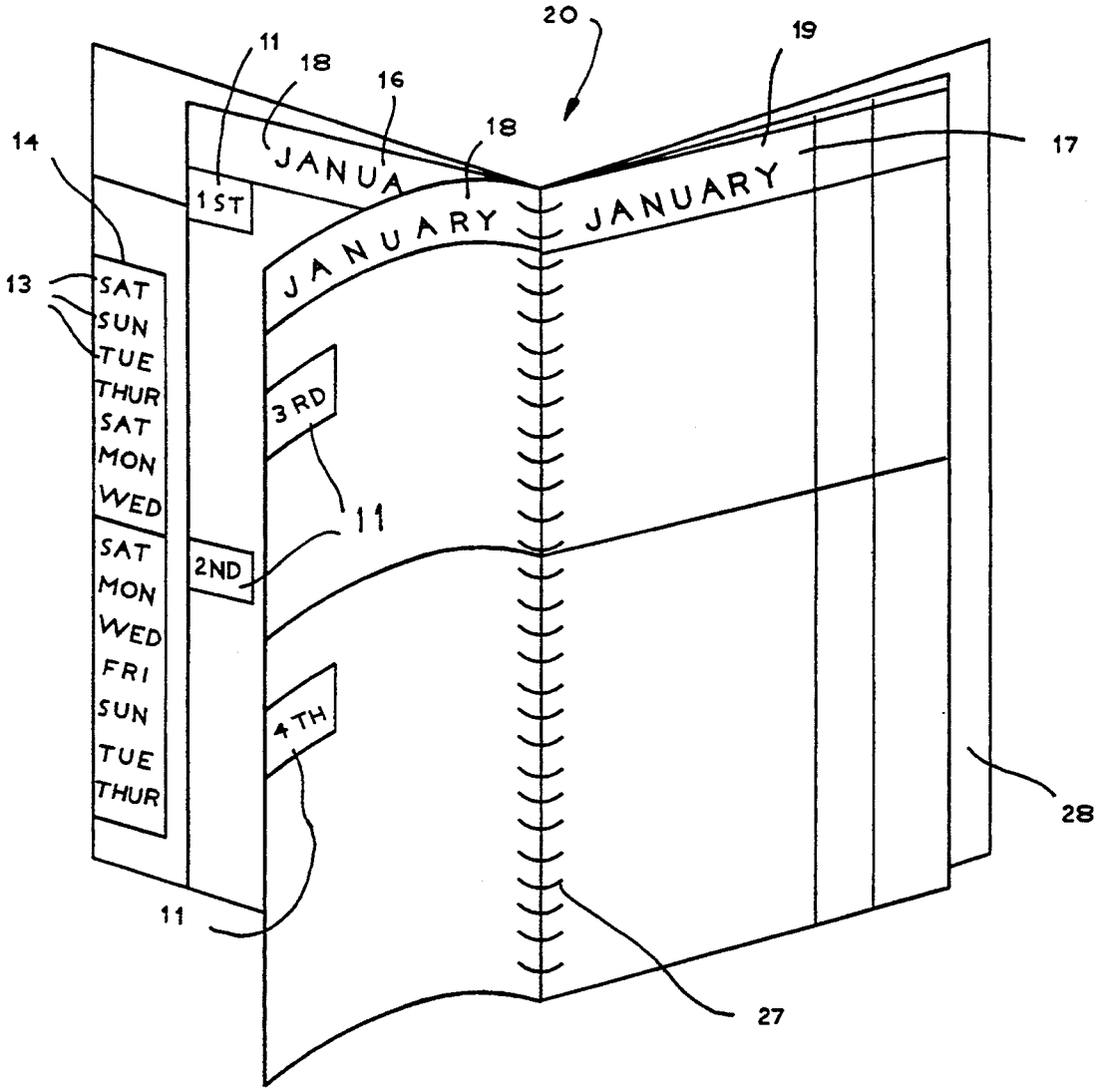
FIG. 2 illustrates an example of a two day to an opening variable period year diary according to a preferred embodiment of the invention.

Referring to FIG. 2, a two day to an opening diary 20 includes a plurality of pages each having a left hand page array 18 and a right hand page array 19. The pages are bound by a binding 27 into a cover 28 having a day name portion 14 removably adhered to the inner side as shown. The day name portion 14 has a plurality of day names 13 set out for operable alignment with diary dates 11 on the respective left hand page array 18.

In the embodiment shown, the diary dates 11 are placed at the left hand edge of the left hand page 16 and for each subsequent page, the diary date 11 is moved down one space for operable alignment with the subsequent day name 13 set out on the day name portion 14.

Figure 4:
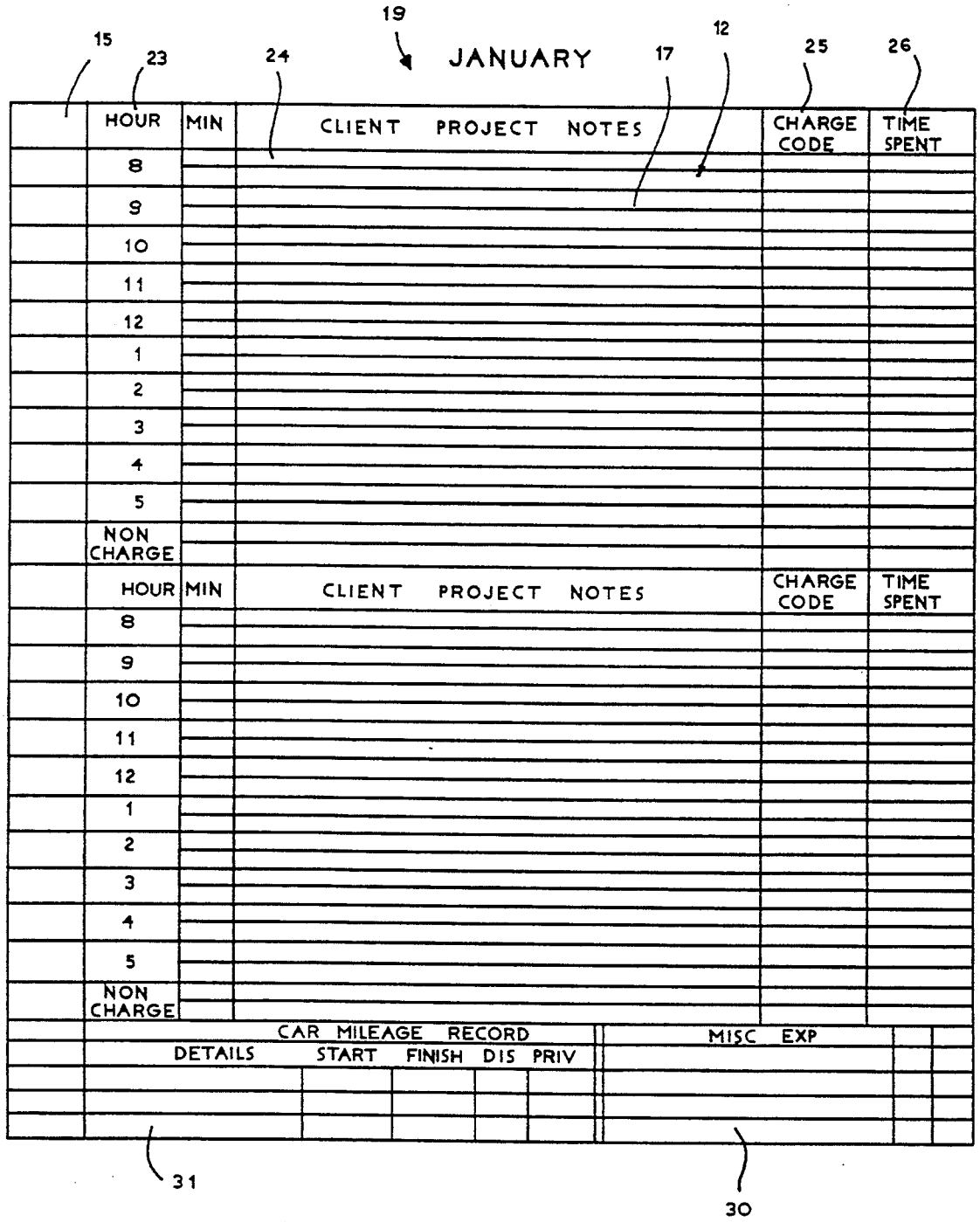
FIG. 4 illustrates the right hand page of the variable period diary shown in FIG. 2.
Figure 5:
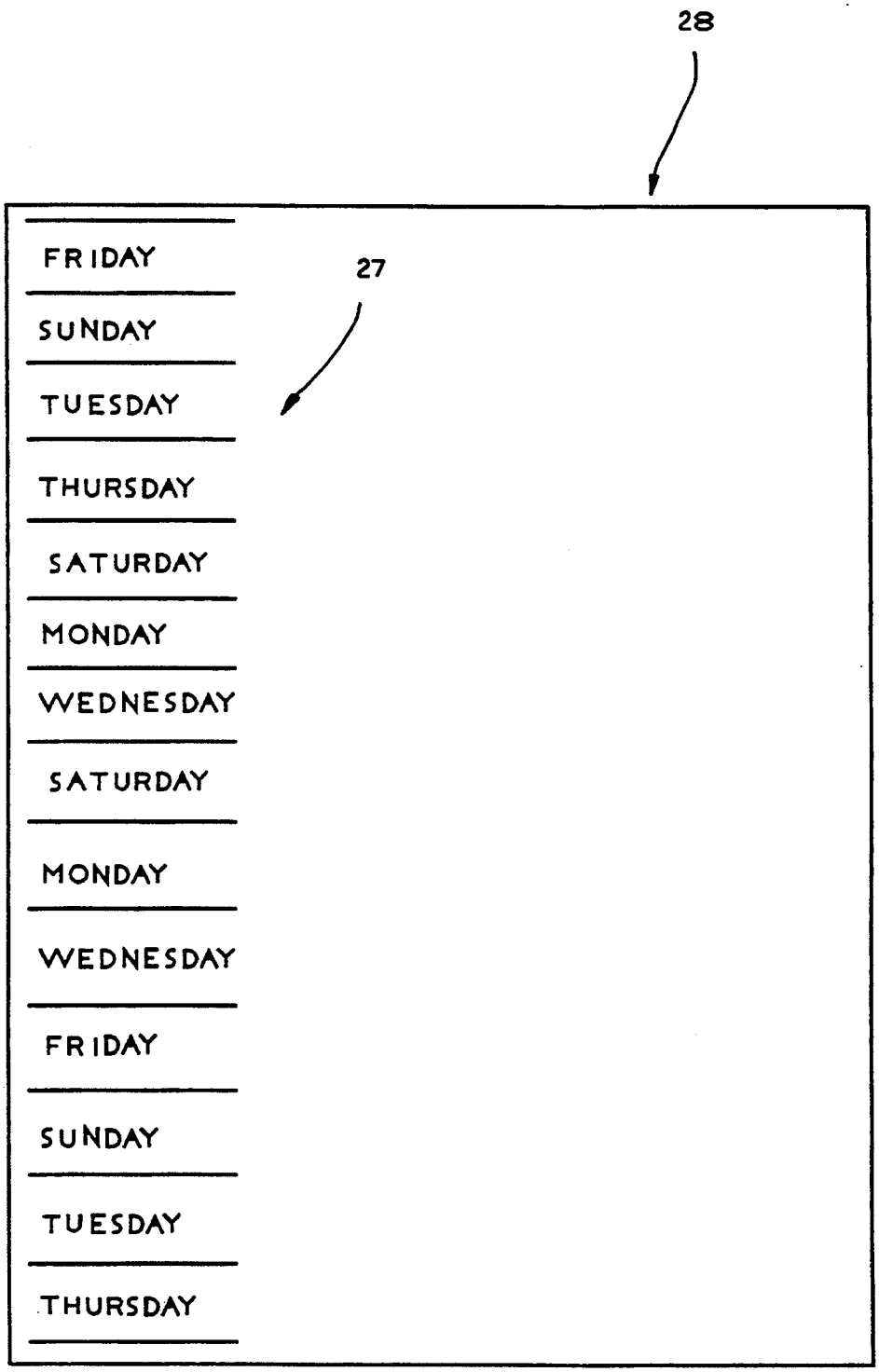
FIG. 5 illustrates the replaceable element having days thereon operable with the variable period diary illustrated in FIGS. 2 to 4.

Referring to FIG. 5, a replacement element day name portion 14 has a plurality of day names 13 set out on the left hand edge. For the example illustrated in FIGS. 2 to 5, the two day to an opening type diary requires that the day names 13 be set out in alternate days for two weeks, the alternate days interleaved from the first week set out in the second week. Thus, for a year starting on Jan. 1, 1993, the day name portion 14 has the days Friday, Sunday, Tuesday, Thursday, Saturday, Monday and Wednesday set out for the first week and Saturday, Monday, Wednesday, Friday, Sunday, Tuesday and Thursday set out for the second week so that the first and eighth day name 13 are in operational alignment with the first page, the second and ninth day names 13 are in operational alignment with the second page, the third and tenth day names 13 are in operational alignment with the third page and so on.

To accommodate the provision of leap years, it is preferred that the left hand page 16 for the month of February always include a diary date 11 for 29 February and that a second day name portion 14 be provided for the portion of the year after 29 February for a leap year.

In the embodiment shown, the day name portion 14 is an adhesive backed page which may be adhered to the inner cover of the diary 20 and is removed and replaced with a further day name portion 14 for the following year. Alternatively, the cover 28 may be provided with a pocket having a clear or transparent inner cover for inserting the day name portion 14 for the appropriate year.

Figure 6:
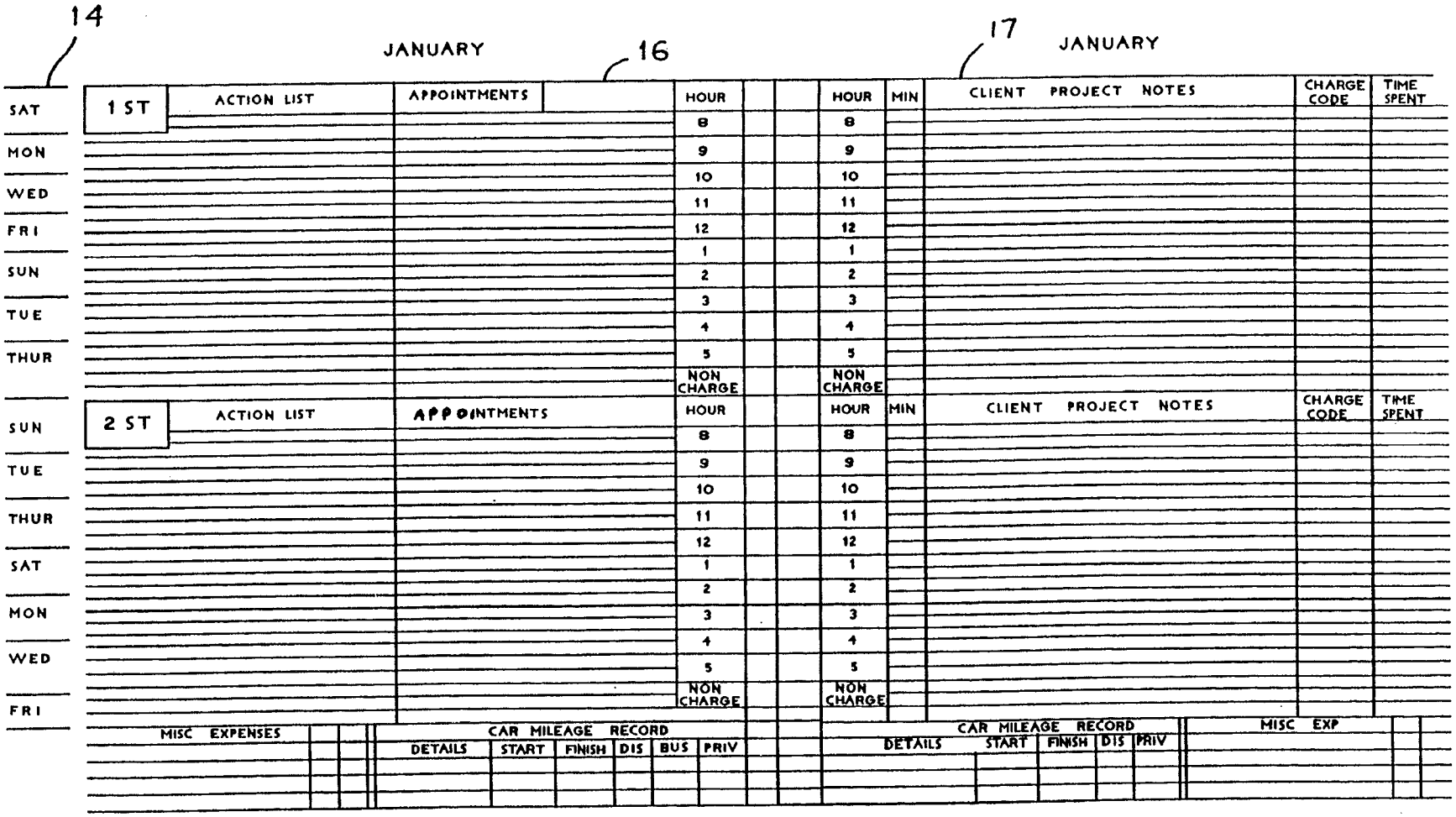
FIG. 6 illustrates a single opening of the two day to an opening variable period diary for a subsequent year to the illustration shown in FIGS. 2 to 5.

Suitably, a diary may be provided with seven day name portions 14 to encompass all of the possible combinations of day names 13 with diary dates 11 which may incur in an operational diary. Thus, the day name portion 14 will have the respective day names 13 advanced by one day for every year except for a leap year, and the advancement by one day for the beginning of a leap year up to and including February 29 and by a further day for the remainder of the leap year after February 29 . Accordingly, the left hand and right hand pages 16 and 17 respectively as shown in FIG. 6 may be provided with a day name portion 14 suitable for the years 1994, 2000, 2005, 2011, 2022, 2028, 2033 and so on.

Figure 3:
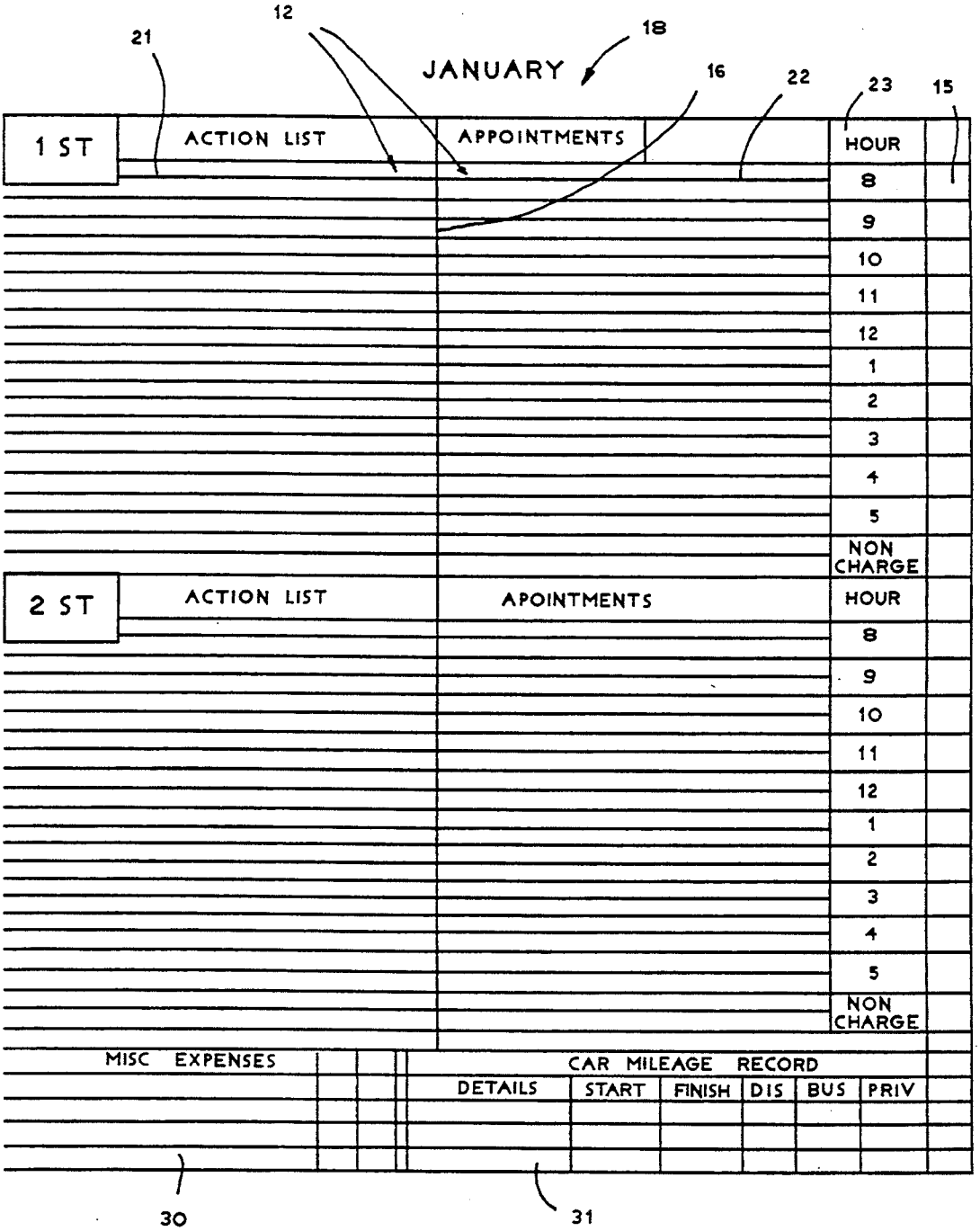
FIG. 3 illustrates the left hand page of the variable period dairy shown in FIG. 2

Referring to FIGS. 3 and 4, the left hand and right hand pages 16 and 17 respectively include a notepad portion 12 set out to include such elements as an action list column 21 an appointments column 22, a time column 23, a notes column 24, a charge code column 25 and a time spent column 26. Each page also further includes an expenses portion 30 and a travel portion 31. For convenience of manufacture, each page also includes a binding column 15.

In use, the variable period diary may be published with the days of the week aligned for the year 1993. If the diary is not sold then the day of the week data can be removed and/or replaced with day of the week data for 1994. Alternatively, if a purchaser wishes to have a diary for an earlier year such as 1986, for example, then the day of the week data may be removed and/or replaced so that the day of the week data corresponds for the year 1986.

The diary of this invention may be spirally bound with looseleaf pages, however, it will be appreciated that other forms of binding may be used whilst still accommodating the features of this invention. Moreover, other ancillary information of the type frequently found in a diary either interleaved within, before or after the sequence of dated pages may be provided without departing from the scope of the invention herein described.

It will of course be realised that while the above has been given by way of illustrative example of this invention, all such and other modifications and variations thereto as would be apparent to persons skilled in the art are deemed to fall within the broad scope and ambit of this invention as defined in the following claims.

I claim:

1. A variable period diary assembly comprising:

a plurality of pages;

information zones on said pages;

date data arranged with said information zones and arranged sequentially on said pages, each page having date data vertically spaced apart;

a single list of day names for a selected period, said list having the day names for n weeks in fixed order and vertically spaced apart, skipping every other n−1 day or days, and each successive week of day names beginning with the day name following that beginning the preceding week;

support means for supporting said list of day names such that said day names are visible beyond the boundary of said pages; and said date data being positioned on each said information zone for visual alignment with the current day name on said list for the selected period.

2. The diary assembly of claim 1, wherein said day names are operatively aligned with said date data arranged with said information zones to provide said day names associated with date data for a selected period.

3. The diary assembly of claim 2, wherein said alignment of said element with said date data may be effected by adhesively attaching said element to the diary.

4. The diary assembly of claim 1, wherein said list of day names is provided separately from said pages.

5. The diary assembly of claim 1, wherein said list of day names is a replaceable element supported in a fixed location at which said element cooperates with an open page of said pages, said element having said day names arranged thereon for operative alignment with said date data.

6. The diary assembly of claim 1, wherein said support means includes a page or cover extending outwardly beyond said pages.

7. The diary assembly of claim 6, wherein said day names are disposed on an overlay printed on a transparent material removable attachable to said page or cover.

8. The diary assembly of claim 7, wherein said overlay is a pocket adapted to fit over said page or cover.

9. A variable year diary assembly comprising:

a plurality of pages;

information zones on said pages;

day date data arranged with said information zones and arranged sequentially on said pages, each page having n date data vertically spaced apart;

a single list of day names, said list having the day names for n weeks in fixed order and vertically spaced apart, skipping every other n−1 day or days, and each successive week of day names beginning with the day name following that beginning the preceding week;

support means for supporting said list of day names such that said day names are visible beyond the left hand boundary of said pages;

the day date of said day date data being disposed on each said information zone for visual alignment with the current day name on said list, and said list of day names being disposed on a replaceable element supported in a fixed location at which said element cooperates with an open page of said pages, said element having said day names arranged thereon for said visual alignment with said day date data.

* * * * *